US005679032A

United States Patent [19]

Auclair

[11] Patent Number: 5,679,032

[45] Date of Patent: Oct. 21, 1997

[54] STRAIN RELIEF DEVICE FOR CLAMP ASSEMBLY

[75] Inventor: John W. Auclair, Norfolk, Conn.

[73] Assignee: Electric Motion Company, Inc., Winsted, Conn.

[21] Appl. No.: 576,446

[22] Filed: Dec. 21, 1995

Related U.S. Application Data

[63] Continuation-in-part of Ser. No. 395,453, Feb. 28, 1995, Pat. No. 5,597,314, which is a continuation-in-part of Ser. No. 58,159, May 5, 1993, Pat. No. 5,429,532.

[51] Int. Cl.[6] ..... H01R 13/648

[52] U.S. Cl. ..... 439/793; 439/812; 439/98

[58] Field of Search ..... 439/793, 98, 100, 439/810, 814, 811, 812; 24/135 N, 135 R

[56] References Cited

U.S. PATENT DOCUMENTS

| | | | |
|---|---|---|---|
| 2,006,794 | 7/1935 | Davidson | 439/812 |
| 2,088,481 | 7/1937 | Mylius | 439/812 |
| 2,197,000 | 4/1940 | MacLean | 439/779 |
| 2,693,587 | 11/1954 | Davidson | 439/812 |
| 2,812,963 | 11/1957 | Johansson | 439/793 |
| 3,544,955 | 12/1970 | Ruiz | 24/135 N |
| 4,147,446 | 4/1979 | Frank, Jr. | 439/793 |
| 4,257,658 | 3/1981 | Hammon et al. | 439/98 |
| 4,623,205 | 11/1986 | Barron | 439/96 |
| 4,639,056 | 1/1987 | Lindeman et al. | 439/79 |
| 4,646,395 | 3/1987 | Mayszak | 24/135 R |
| 4,842,530 | 6/1989 | Erickson, II et al. | 439/98 |
| 5,021,014 | 6/1991 | Walter et al. | 439/798 |
| 5,197,907 | 3/1993 | Hurtgen | 439/810 |

FOREIGN PATENT DOCUMENTS

| | | | |
|---|---|---|---|
| 525849 | 6/1956 | Canada | 439/793 |
| 895016 | 10/1953 | Germany . | |

*Primary Examiner*—Gary F. Paumen
*Attorney, Agent, or Firm*—Chilton, Alix & Van Kirk

[57] ABSTRACT

A ground clamp for clamping to a cable shield to provide a round connection employs a U-shaped yoke. A keeper has a driver which threadably engages thread surfaces at the interior side of the yoke legs. The keeper has a clamp jaw which may be compressively engaged against a cable shield received in an aperture defined by the yoke. The yoke connects to a common ground point via a ground connector member. The ground connector member has a grounding portion which may comprise a flexible ground connector or a rigid conductive plate. A bracing portion of the ground connector member is connected to the grounding portion by a ramp portion which projects laterally towards the cable. The bracing portion includes two arms which project laterally from a center connector portion. The connector portion and arms define a horseshoe-shaped stress relief clamp which may be crimped into engagement with the cable to mechanically connect the ground clamp with the cable outer jacket.

21 Claims, 3 Drawing Sheets

STRAIN RELIEF DEVICE FOR CLAMP ASSEMBLY

CROSS REFERENCE TO RELATED APPLICATION

This is a continuation-in-part of application Ser. No. 08/395,453 filed on Feb. 28, 1995 U.S. Pat. No. 5,597,314 which is a continuation-in-part of Ser. No. 58,159 filed on May 5, 1993 U.S. Pat. No. 5,429,532.

BACKGROUND OF THE INVENTION

This invention relates generally to devices for implementing a ground connection between a metallic shield of a cable and a common ground point. More particularly, the present invention relates generally to clamp devices which mount to service cables and connect with a common ground point.

Various types of devices have been employed for connecting a ground wire with the tubular ground shields of buried service wires. Most conventional devices employ clamp assemblies of various forms. In applications to which the present invention relates, the connecting devices are ordinarily positioned within a cabinet, housing or other enclosure, hereafter collectively termed "enclosure", to provide a grounding connection between the metallic shield of the service cable and a common ground point. Frequently, there is a minimal amount of available space within the enclosures for such ground connecting devices.

A number of conventional designs are configured to mount rigidly or semi-rigidly within the enclosures. For such designs, damage to the cables can occur when the enclosure is subject to intense environmental changes and the cables are fixedly positioned in the ground. For example, it is not uncommon for the enclosure to heave as a result of frost while the service cables are frozen in position in the ground. In addition, such devices typically clamp directly to the cable shield. Such shields are not generally designed with high strength requirements and are easily damaged by forces transmitted to the shield by the cable clamp. In addition, such forces are generally concentrated along the edge of the cable clamp. Consequently, relatively minor forces may cause damage or shearing of the cable shield.

U.S. Pat. No. 4,646,395 discloses one type of cable clamp to which the present invention generally relates. The clamp has a stamped metal body portion with two end walls that extend at right angles to the base. A pair of arms spaced intermediate along one edge of the base extend outwardly at essentially right angles to the base such that they are parallel to the end walls. An arm and an associated end wall form channels. A moveable jaw interfits below the arms. The jaw is tightenable into compressive engagement with the cables which are received in the channels.

SUMMARY OF THE INVENTION

Briefly stated, the invention in a preferred form is a cable shield ground clamp having apparatus for relieving strain on the cable shield which strain is typically transmitted by the cable shield ground clamp. The clamp assembly comprises a generally U-shaped yoke which defines a service cable receiving aperture. The legs of the yoke have opposed thread surfaces. A keeper is threadable with the thread surfaces of the yoke and torquable for displacement relative to the yoke. The keeper includes a clamp jaw which is compressively engageable against a service wire ground shield received in the aperture.

The keeper has a rotatably mounted threaded driver which engages with the yoke. A slot in the bottom of the driver facilitates the threadable displacement of the keeper to implement the clamp connection. The keeper has a pair of skirts which define opposed openings through which the legs of the yoke are received. The keeper may also have a lock mechanism for resisting relative rotational movement between the threaded driver and the keeper clamp jaw when the clamp is installed on the cable.

The yoke includes a set screw or other means for connecting the yoke with a grounding member and a strain relief member. In one embodiment, the strain relief member and the grounding member are separate structures. In a preferred embodiment the grounding member and the strain relief member comprise first and second end portions, respectively, of an integral structure.

In the preferred embodiment, a pair of arms laterally extend from the second end portion toward the legs to define a cable jacket clamp. The cable jacket clamp is crimped into engagement with a cable received between the arms to mechanically couple the grounding member to the cable jacket. Mechanical forces such as movement of the cable or cable tension are preferably transmitted to the clamp assembly via the cable jacket and cable jacket clamp, reducing or eliminating the force that is imposed on the cable shield.

The distal end portions of the legs flare outwardly to facilitate gripping the distal end portions for crimping the cable jacket clamp. In a preferred embodiment, the second end portion is mounted to the intermediate portion of the grounding member by a ramp segment. The ramp segment extends obliquely downward so that the top inside surface of the second end portion is positioned adjacent the cable jacket. Such structure functions to strengthen the connection with the second end portion.

An object of the invention is to provide a new and improved cable shield ground clamp for implementing a ground connection between the metallic shield of a service cable and a common ground point.

Another object of the invention is to provide a new and improved cable shield ground clamp which reduces the stress applied to the cable shield.

A further object of the invention is to provide a new and improved cable shield ground clamp which bonds with a shielded cable in a manner which provides superior mechanical strength by preferentially applying stress and tension to the cable jacket instead of the cable shield.

Other objects and advantages of the invention will become apparent from the specification and the drawings.

DETAILED DESCRIPTION OF THE PREFERRED EMBODIMENT

Figure 1:
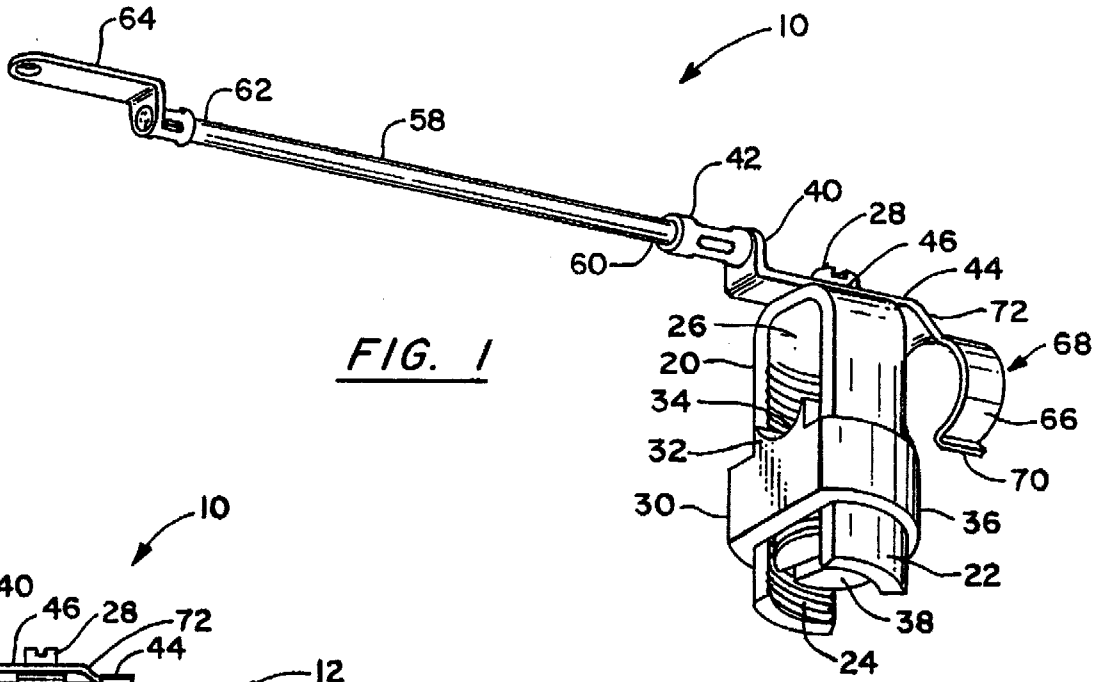
FIG. 1 is a perspective view of a cable shield ground clamp having a strain relief device in accordance with the present invention, illustrated in conjunction with a ground wire.

With reference to the drawings wherein like numerals represent like parts throughout the Figures, a cable shield ground clamp in accordance with the present invention is generally designated by the numeral 10. The clamp 10 is particularly adapted for receiving one or more service wires or cables 12 (FIG. 2) and connecting the tubular metallic shields 14 of the wires to a common ground point. The cable shield ground clamp 10 is adapted for use in an enclosure (not illustrated), such as a cabinet or other housing. The cable shield ground clamp 10 comprises a structure for relieving strain which is typically transmitted to the cable shield 14 at the primary clamp interface and, in particular, at the edges of the interface. In some instances, the magnitude of the strain in prior art ground clamps is sufficient to shear, perforate or damage the cable shield 14.

The cable shield ground clamp 10 comprises a generally U-shaped yoke 20 having generally parallel legs 22. The legs 22 of the yoke 20 have respective opposed inwardly disposed thread surfaces 24. A receiving aperture 26 is generally formed at the upper inward portion of the yoke 20 for receiving one or more service wire ground shields 14. A set screw 28, which may be any of numerous conventional forms, is threaded at the upper cap of the yoke 20 for anchoring the grounding member 40.

The ground shields 14 are compressively secured to the clamp 10 by means of a keeper 30 which is slidably displaceable and selectively fixedly positionable along the legs 22 of the yoke 20. The keeper 30 includes an upper clamp jaw 32 which in a preferred form has a laterally extending V-shaped recess or groove 34. The groove 34 enhances surface contact with the ground shield 14 and provides a more intimate clamping engagement. The body of the keeper 30 includes a pair of integral guide skirts 36. The guide skirts 36 form axial openings which are dimensioned to be greater than the sections of the legs 22 of the yoke 20 to permit sliding displacement relative thereto. The guide skirts 36 also function to limit lateral separation between the legs 22 of the yoke 20 which are generally parallel regardless of the position of the keeper 30. The yoke 20 and the keeper 30 typically have a tin plated brass composition or a zinc with copper/tin plated composition.

The position and displacement of the keeper 30 is governed by a threaded driver 38. The threaded driver 38 is rotatably mounted at the underside of the clamp jaw. The driver 38 has a helical threaded surface which is dimensioned for threading engagement with the complementary thread surfaces 24 of the yoke 20. The underside of the driver 38 includes a recessed slot which is dimensioned to receive a blade of a screwdriver or similar tool for torquing the driver. The recess walls retain the blade as it rotates. Alternately, the slot may not be recessed. The driver 38 threadably engages the surface 24 of the yoke 20 and is threadably displaceable along the legs 22 of the yoke 20 for selectively compressively clamping the jaw 32 against a received ground shield 14. The clamp engagement with the ground shield 14 is maintained by the threaded engagement between the driver 38 and the yoke 20 which is also laterally reinforced by the guide skirts 36.

The open ended design for clamp 10 allows the keeper 30 to be completely dismounted from the yoke 20 so that the clamp 10 may be installed onto a wire 12 which is already in service. In addition, the clamp 10 may be disassembled, i.e., the keeper 30 disengaged from the yoke 20, to isolate the ground.

The strain relief is preferably incorporated into a structure leading from the ground connecting structure. In a preferred embodiment, the grounding member 40 has a grounding end portion 42, an oppositely disposed bracing end portion 44, and an intermediate portion 46 disposed between the grounding and bracing portions 42, 44. The intermediate portion 46 has an opening for receiving the set screw 28. The grounding portion 42 provides means for connecting the clamp 10 to ground and the bracing portion 44 provides means for relieving the strain on the cable shield 14. Alternatively, the grounding portion may be separate from the bracing portion.

The grounding member may assume a number of alternate configurations such as are illustrated in the Figures. Corresponding elements for the alternate embodiments are denoted by three digit numerals comprising identical trailing two digit designations and lead digit designations identifying the embodiment.

Figure 2:
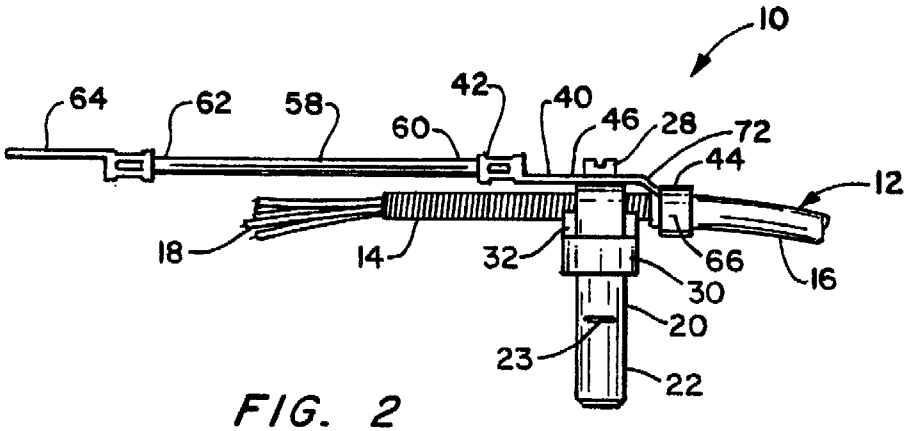
FIG. 2 is a side elevational view of the cable shield ground clamp and ground wire of FIG. 1 together with a service cable.

In the embodiment shown in FIGS. 1 and 2, the first end 60 of a flexible cable 58 is mounted to the grounding portion 42 of the grounding member 40 and the second end 62 of the cable 58 is mounted to a ground connector 64. The cable 58 is typically a six inch #6 or #10 AWG lead wire.

Figure 3:
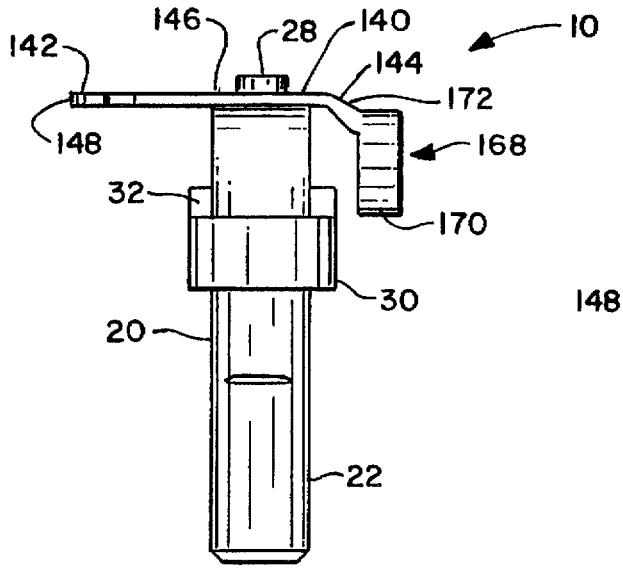
FIG. 3 is a side view of an alternate embodiment of the cable shield ground clamp of FIG. 1.
Figure 4:
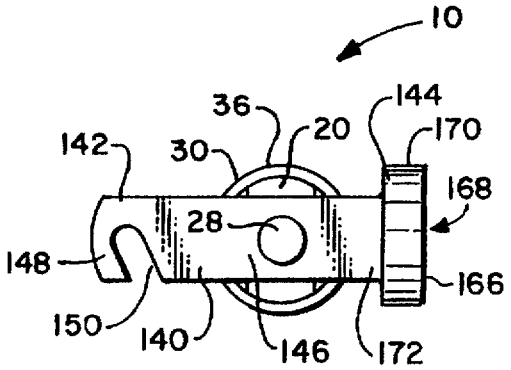
FIG. 4 is a top view of the cable shield ground clamp of FIG. 3.
Figure 5:
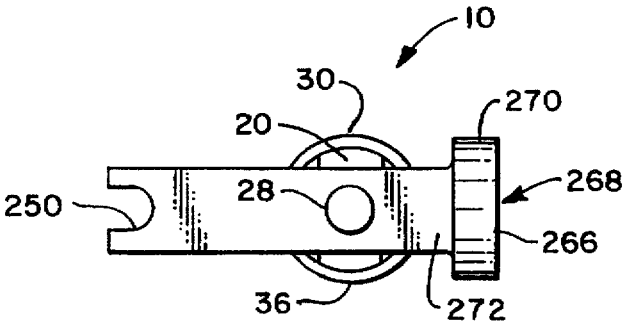
FIG. 5 is a top view of a modified embodiment of the cable shield ground clamp of FIG. 3.

In the embodiment shown in FIGS. 3 and 4, the grounding portion 142 comprises a connector 148 for connecting to a ground. In this embodiment, the grounding portion 142 comprises a plate composed of electrically conductive material which extends from the intermediate portion 146 of the grounding member 140. An opening in the form of a half circle 250 (FIG. 5) or slot 150 (FIG. 4) is provided to facilitate connecting the grounding portion 142 to the ground.

Figure 6:
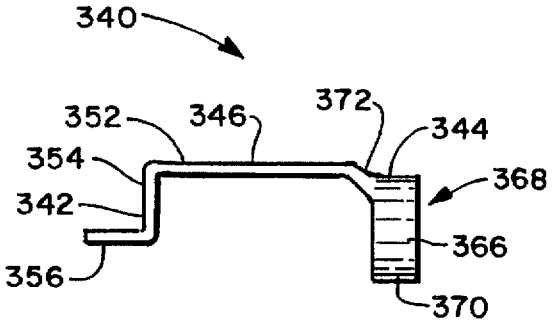
FIG. 6 is a side view of the grounding member of the cable shield ground clamp of FIG. 5.
Figure 7:
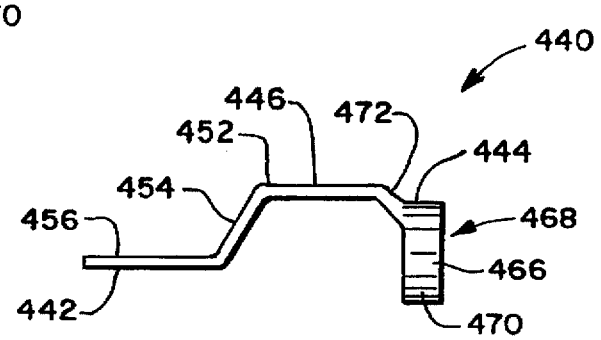
FIG. 7 is a side view of a second modified embodiment of a grounding member for the cable shield ground clamp of FIG. 3.
Figure 8:
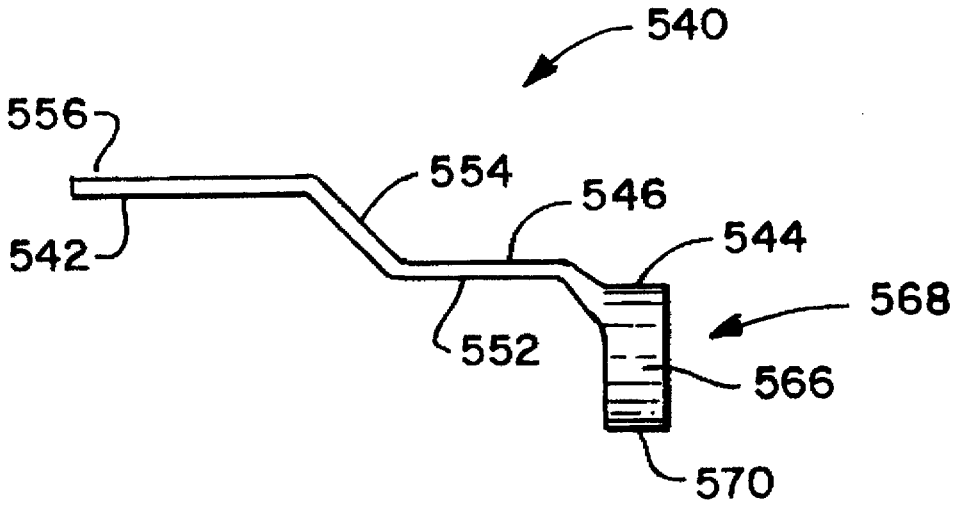
FIG. 8 is a side view of a third modified embodiment of a grounding member for the cable shield ground clamp of FIG. 3.

The grounding portion 42 may be formed into a variety of configurations to facilitate connecting to the ground. In the embodiment shown in FIGS. 3 and 4, the grounding portion 142 has the form of a flat plate. In the embodiments shown in FIGS. 6, 7 and 8 the grounding portion 342, 442, 542 comprises three non-coplanar segments. In FIG. 6, the first segment 352 extends outwardly from the intermediate portion 346 of the grounding member 340, the second segment 354 extends downwardly from the first segment 352 at an angle substantially equal to 90°, and the third segment 356 extends outwardly from the second segment 354 such that the third segment 356 is substantially parallel to the first segment 352. In FIG. 7, the first segment 452 extends outwardly from the intermediate portion 446 of the grounding member 440, the second segment 454 extends obliquely downward from the first segment 452 at an angle substantially equal to 45°, and the third segment 456 extends outwardly from the second segment 454 such that the third segment 456 is substantially parallel to the first segment 452. In FIG. 8, the first segment 552 extends outwardly from the intermediate portion 546 of the grounding member 540, the second segment 554 extends obliquely upward from the first segment 552 at an angle substantially equal to 45°, and the third segment 556 extends outwardly from the second segment 554 such that the third segment 556 is substantially parallel to the first segment 552.

A pair of arms 66 laterally extend from the bracing portion 44 toward the legs 22 to define a cable jacket clamp 68. The cable jacket clamp 68 is crimped into engagement with a cable 12 received between the arms 66 to mechanically couple the grounding member 40 to the cable jacket 16. The arms 66 engage the cable jacket 16 at a position which is longitudinally spaced from the position where the keeper 30 engages the cable shield 14. Mechanical forces such as movement of the cable 12 or cable tension are therefore preferentially transmitted to the clamp assembly 10 via the cable jacket 16 and cable jacket clamp 68, reducing or eliminating any shearing, perforating or damaging force that may be imposed on the cable shield 14 at the edges of the primary clamp interface.

Figure 9:
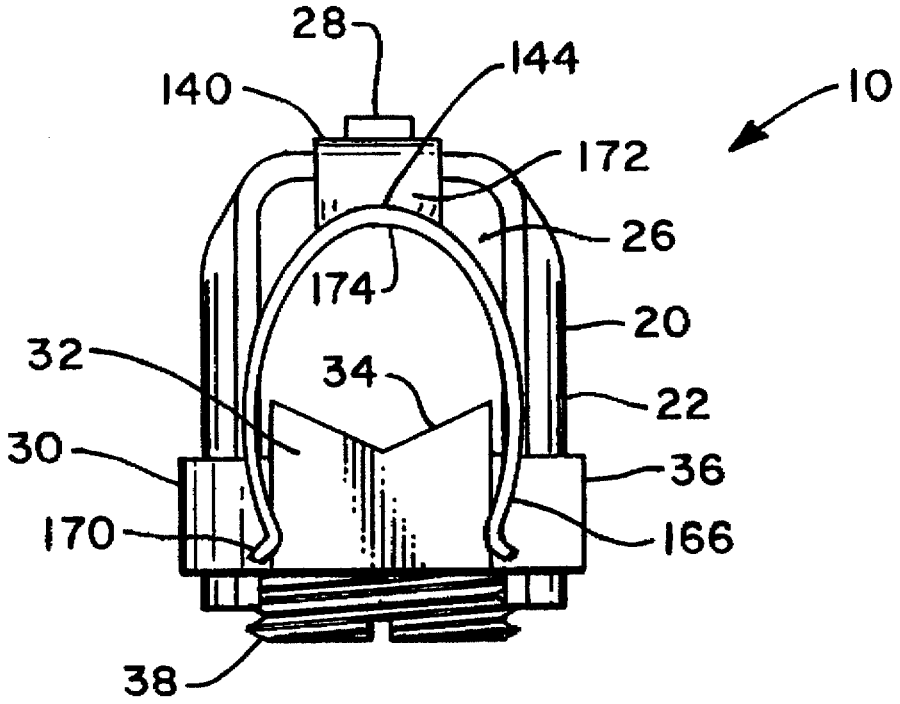
FIG. 9 is an end view of the cable shield ground clamp of FIG. 3.

The distal end portions 70 of the arms 66 flare outwardly to facilitate gripping the distal end portions 70 for crimping the cable jacket clamp 68. As shown in FIG. 9, the bracing portion 144 and the two arms 166 have arcuate shapes wherein they define a horseshoe-shaped clamp. In a preferred embodiment, the bracing portion 44 is mounted to the intermediate portion 46 of the grounding member 40 by a ramp segment 72. The ramp segment 72 extends obliquely downward so that the top inside surface 74 of the bracing portion 44 is positioned adjacent the cable jacket 16. Such construction provides additional strength to the grounding member 40 and limits the lateral movement of the cable 12 during crimping, thereby eliminating a source of strain on the cable shield 14.

The ground clamp 10 has particular applicability for buried service wires. The service wires 12 are connected by initially exposing approximately one inch of the ground shield 14. The service pairs 18 and ground shield 14 are inserted into the receiving aperture 26 and the cable 12 is inserted between the arms 66 of the cable jacket clamp 68. The keeper jaw 32 is compressively tightened against the shield 14 upon insertion of a screwdriver blade into the slot and torquing the screwdriver. The distal end portions 70 of the arms 66 are crimped towards the cable 12 with pliers or other suitable tools. The legs 22 may have indentations 23 that facilitate removal of the distal portions of the legs 22.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A cable shield ground clamp for a cable having an outer jacket and an interiorly disposed shield, said clamp comprising:

yoke means defining a receiving aperture;

keeper means mounted to said yoke means, said keeper means comprising driver means and clamp jaw means disposed within said yoke means, said driver means being engageable with said yoke means for variable positioning said clamp jaw means and for maintaining the position of said clamp jaw means at a selected fixed position relative to said yoke;

ground connection means for connecting said clamp with a ground connector; and strain relief means for distributing forces imposed on the cable by said clamp from the shield of the cable to the jacket of the cable.

2. The cable shield clamp of claim 1 wherein said ground connection means and said strain relief means comprise a grounding portion and a bracing portion of a grounding member, said grounding member further comprising an intermediate portion disposed intermediate said grounding and bracing portions, said grounding member defining a longitudinally extending axis wherein said axis is generally perpendicular to said yoke means.

3. The cable shield clamp of claim 2 wherein said bracing portion comprises clamp means for clamping the cable jacket.

4. The cable shield clamp of claim 3 wherein said clamp means comprises first and second arms, said first and second arms extending laterally from said bracing portion.

5. The cable shield clamp of claim 4 wherein each of said arms comprises an outwardly extending distal end portion.

6. The cable shield clamp of claim 2 wherein said grounding member further comprises a ramp portion disposed intermediate said intermediate portion and said bracing portion, said ramp portion laterally extending from said intermediate portion towards said legs.

7. The cable shield clamp of claim 4 wherein said bracing portion and said first and second arms each have arcuate shapes.

8. The cable shield clamp of claim 4 wherein said bracing portion and said first and second arms define a horseshoe-shaped clamp.

9. A cable shield ground clamp for a cable having a conductive shield surrounded by an outer jacket, the clamp comprising:

a generally U-shaped yoke having a pair of generally parallel legs and defining a receiving aperture for receiving said conductor and said shield, said legs having opposed thread surfaces;

keeper means mounted to said yoke, said keeper means comprising driver means and clamp jaw means disposed between said legs, said driver means being threadably engageable with said yoke thread surfaces for variable positioning said clamp jaw means therealong and for maintaining the position of said clamp jaw means at a selected fixed position relative to said yoke, wherein said clamp jaw means engages said conductive shield; and strain relief means for distributing forces imposed on the cable by said clamp from the shield of the cable to the jacket of the cable, said strain relief means comprising a member having a ground connection portion for connecting said yoke with a ground connector and a bracing portion engageable with the cable jacket.

10. The cable shield clamp of claim 9 wherein said bracing portion comprises clamp means for clamping the cable jacket.

11. The cable shield clamp of claim 9 wherein said bracing portion comprises a mounting portion mounted to said ground connection portion and first and second arms laterally extending from said mounting portion.

12. The cable shield clamp of claim 11 wherein said mounting portion comprises a ramp portion and a connector portion wherein said ramp portion is disposed intermediate said ground connection means and said connector portion, said ramp portion laterally extending from said ground connector towards said legs.

13. The cable shield clamp of claim 12 wherein said connector portion and said first and second arms each have arcuate shapes.

14. The cable shield clamp of claim 12 wherein said connector portion and said first and second arms define a horseshoe-shaped clamp.

15. A cable shield ground clamp assembly comprising:

a cable comprising at least one conductor, an outer jacket, and a conductive shield intermediate said conductor and said jacket;

yoke means defining a receiving aperture;

keeper means mounted to said yoke means, said keeper means comprising driver means and clamp jaw means disposed within said yoke means, said driver means being engageable with said yoke means for variable positioning said clamp jaw means and for maintaining the position of said clamp jaw means at a selected fixed position relative to said yoke, wherein said clamp jaw means and said yoke means engage said conductive shield;

ground connection means for connecting said yoke means with a ground connector; and strain relief means for distributing forces imposed on the cable by said keeper means and said yoke means from said shield of said cable to said jacket of said cable.

16. The cable shield clamp assembly of claim 15 wherein said strain relief means comprises clamp means for clamping the cable jacket.

17. The cable shield clamp assembly of claim 16 wherein said strain relief means further comprises a ramp portion wherein said ramp portion is disposed intermediate said ground connection means and said clamp means, said ramp portion laterally extending from said ground connector means towards said cable.

18. The cable shield clamp assembly of claim 17 wherein said clamp means comprises a mounting portion mounted to said ramp portion and first and second arms laterally extending from said mounting portion.

19. The cable shield clamp assembly of claim 18 wherein said connector portion and said first and second arms each have arcuate shapes.

20. The cable shield clamp assembly of claim 18 wherein said connector portion and said first and second arms define a horseshoe-shaped clamp.

21. The cable shield clamp assembly of claim 15 wherein said keeper means and said yoke means engage said cable shield at a first position and said strain relief means engages said cable jacket at a second position which is longitudinally spaced from said first position.

* * * * *